US009714163B2

(12) United States Patent
Standaert et al.

(10) Patent No.: US 9,714,163 B2
(45) Date of Patent: Jul. 25, 2017

(54) CONTAINER FOR STORING A LIQUID FOODSTUFF AND DISPENSING IT UNDER PRESSURE

(75) Inventors: Geert Norbert T. Standaert, Zonhoven (BE); Imar Vandebriel, Hechtel-Eksel (BE)

(73) Assignee: CARDIFF GROUP, NAAMLOZE VENNOOTSCHAP, Zonhoven (BE)

( * ) Notice: Subject to any disclaimer, the term of this patent is extended or adjusted under 35 U.S.C. 154(b) by 183 days.

(21) Appl. No.: 14/124,806

(22) PCT Filed: May 15, 2012

(86) PCT No.: PCT/BE2012/000024

§ 371 (c)(1),
(2), (4) Date: Dec. 9, 2013

(87) PCT Pub. No.: WO2012/167333

PCT Pub. Date: Dec. 13, 2012

(65) Prior Publication Data

US 2014/0103066 A1 Apr. 17, 2014

(30) Foreign Application Priority Data

Jun. 9, 2011 (BE) ..... 2011/0352

(51) Int. Cl.
*B65D 35/28* (2006.01)
*B67D 1/04* (2006.01)
(Continued)

(52) U.S. Cl.
CPC ..... *B67D 1/045* (2013.01); *B65D 77/06* (2013.01); *B67D 1/0418* (2013.01); *B67D 1/0801* (2013.01); *B67D 2001/0828* (2013.01)

(58) Field of Classification Search
CPC ..... B67D 1/0462; B67D 1/0418; B67D 1/04; B67D 1/0801; B67D 1/045
(Continued)

(56) References Cited

U.S. PATENT DOCUMENTS 927,798 A * 7/1909 Hoff ..... 222/5
1,056,394 A * 3/1913 Bernard-Schmoller ..... 222/396
(Continued)

FOREIGN PATENT DOCUMENTS

DE 10 2004 054 272 A1 5/2006
DE 20 2008 007 255 U1 10/2009
(Continued)

OTHER PUBLICATIONS

International Search Report for PCT/BE2012/000024, dated Sep. 19, 2012.

*Primary Examiner* — Patrick M Buechner
*Assistant Examiner* — Michael J Melaragno
(74) *Attorney, Agent, or Firm* — Sughrue Mion, PLLC

(57) ABSTRACT

A container (1) for storing a liquid foodstuff (4) and dispensing it under pressure in consumption portions via a closable dispensing channel, characterized in that it comprises a rigid outer container (2), a flexible inner container (3) for the foodstuff (4), and at least one intermediate container (5) surrounding the inner container (3), whereby an intermediate container (5) on the one hand, and another intermediate container (5) or the inner container (3) located within it on the other hand, define a space (16), whereby the space (16) is provided with a pressure medium and/or the container (1) is equipped with a connection (23) connected to the space for a pressure medium source (24).

16 Claims, 4 Drawing Sheets

(51) Int. Cl.
*B67D 1/08* (2006.01)
*B65D 77/06* (2006.01)

(58) Field of Classification Search
USPC ..... 222/95, 399, 105, 5
See application file for complete search history.

(56) References Cited

U.S. PATENT DOCUMENTS 1,112,386 A * 9/1914 Schatz ..... 222/399
2,172,035 A * 9/1939 Roth ..... 141/17
2,564,163 A * 8/1951 Leperre ..... 141/2
3,266,668 A * 8/1966 Davis ..... 222/5
3,298,571 A * 1/1967 Novak ..... 222/5
3,317,089 A * 5/1967 Kopezynski ..... 222/183
3,811,461 A * 5/1974 Novak ..... 137/318
3,927,801 A * 12/1975 Martin et al. ..... 222/61
4,392,578 A * 7/1983 Fipp et al. ..... 215/231
4,694,850 A * 9/1987 Fumino ..... 137/318
4,921,135 A * 5/1990 Pleet ..... 222/82
4,934,543 A * 6/1990 Schmidt ..... 215/228
5,199,609 A * 4/1993 Ash, Jr. ..... 222/94
5,248,062 A * 9/1993 Hillard ..... 222/81
5,395,012 A * 3/1995 Grill et al. ..... 222/4
5,458,165 A * 10/1995 Liebmann, Jr. ..... 141/64
6,015,068 A * 1/2000 Osgar et al. ..... 222/400.7
6,237,809 B1 * 5/2001 Kawai et al. ..... 222/95
6,260,570 B1 * 7/2001 Wass et al. ..... 137/68.3
7,604,147 B2 * 10/2009 Anderson ..... 222/400.7
7,779,856 B2 * 8/2010 Adams et al. ..... 137/210
8,052,014 B2 * 11/2011 Hasegawa et al. ..... 222/400.7
8,561,853 B2 * 10/2013 De Mei ..... 222/386.5
8,561,856 B2 * 10/2013 Kuperus ..... 222/400.7
8,777,056 B2 * 7/2014 Bates et al. ..... 222/1
2004/0094569 A1 * 5/2004 Colombo ..... 222/5
2006/0138177 A1 * 6/2006 Wauters et al. ..... 222/386.5
2006/0169725 A1 * 8/2006 Grill ..... 222/399
2008/0128456 A1 * 6/2008 Grimwade et al. ..... 222/399
2008/0142553 A1 * 6/2008 Lassen ..... 222/399
2008/0203118 A1 * 8/2008 Sauer et al. ..... 222/396
2008/0217361 A1 9/2008 Vitantonio et al.
2008/0217362 A1 * 9/2008 Vitantonio et al. ..... 222/399
2008/0217363 A1 * 9/2008 Vitantonio et al. ..... 222/399
2009/0045222 A1 * 2/2009 Nimmo et al. ..... 222/95
2009/0057347 A1 * 3/2009 Leys et al. ..... 222/386.5
2009/0060398 A1 * 3/2009 Kawakami et al. ..... 383/93
2009/0261129 A1 * 10/2009 Vitantonio et al. ..... 222/394
2009/0302069 A1 * 12/2009 Oberhofer et al. ..... 222/399
2010/0206900 A1 8/2010 Dobrusskin et al.
2011/0049193 A1 * 3/2011 Muller Kubold et al. ... 222/399
2011/0108574 A1 * 5/2011 Nimmo et al. ..... 222/95
2012/0104035 A1 * 5/2012 Bates et al. ..... 222/1
2012/0187153 A1 * 7/2012 Burge et al. ..... 222/386.5
2013/0292423 A1 * 11/2013 Lambrecht ..... 222/399
2013/0306673 A1 * 11/2013 Manera ..... 222/82
2014/0001205 A1 * 1/2014 Hodges et al. ..... 222/95
2014/0117043 A1 * 5/2014 Ware et al. ..... 222/95

FOREIGN PATENT DOCUMENTS

EP 1 947 029 A1 7/2008
EP 2 186 771 A1 5/2010
WO 2008/066376 A1 6/2008
WO 2008/146240 A2 12/2008

* cited by examiner

CONTAINER FOR STORING A LIQUID FOODSTUFF AND DISPENSING IT UNDER PRESSURE

CROSS REFERENCE TO RELATED APPLICATIONS

This application is a National Stage of International Application No. PCT/BE2012/000024 filed May 15, 2012, claiming priority based on Belgium Patent Application No. 2011/0352, filed Jun. 9, 2011, the contents of all of which are incorporated herein by reference in their entirety.

The present invention relates to a container for storing a liquid foodstuff and dispensing it under pressure.

More specifically the invention is intended for relatively small-scale containers for liquid foodstuffs, from which the foodstuff concerned can be dispensed for consumption.

It concerns small beer kegs for example, both for home use and use in cafes, from which beer can be tapped for the purpose of no longer storing the beer but consuming it. Similarly they can also be containers for other drinks such as soft drinks, wine, milk or milk-based drinks, fruit juices, or viscous foodstuffs such as yoghurt, mayonnaise and other sauces.

Preferably, in order to increase the shelf life of the foodstuffs, the foodstuffs are well separated from air, because the oxygen in the air stimulates the degradation processes in the foodstuff, which at least affect the flavour of the foodstuff, and can even reduce its suitability for consumption. For example with beer, depending on the type, an oxygen content of just 1000 ppb (parts per billion) can be harmful for the flavour.

Such a separation from air is important both before the foodstuff is used for the first time, and also after a part of the foodstuff has been dispensed, but with a part to be dispensed in the future still present in the container.

A container usually has at least two functions however: Firstly, as explained above to ensure that air can't reach the foodstuff, and secondly a mechanical function, i.e. resisting, without damage or deformation, the internal pressure in the container which is needed to dispense the foodstuff.

Such a container is described in WO2011035397 for example, which describes a small beer keg with a dispensing system whereby the keg has a rigid outer container that is gas-tight, and a flexible inner container that is intended to contain beer.

To get the beer out of the keg, pressure is applied with $CO_2$ in the space between the outer container and the inner container, such that the inner container is put under pressure and the beer can flow out of the keg.

A disadvantage of this is that the outer container must be very gas-tight, particularly because otherwise the time during which the keg can be used would be limited because the $CO_2$ supplied can leak away or diffuse away through the material of the outer wall.

This means that this outer container must be made with a lot of attention and precision, and with the use of expensive materials, such that it is expensive.

Also in EP 1947029 a container is disclosed with a similar construction, in a variant in which the outer container is spherical, and which optionally comprises an outer shell to support the outer container so that it may be stably placed upright, which outer shell has no further mechanical function with respect to the capability of the outer container to withstand pressure, nor has a function related to forming a barrier to gas diffusion, either from the inside to the outside or from the outside to the inside.

Another disadvantage is that air can still diffuse into the beer through the dispensing system, such that the shelf life of the beer is limited, even if the inner container and outer container allow absolutely no oxygen through.

The inner container must also be made oxygen-tight, because otherwise air could diffuse into the space between the outer container and the inner container via the dispensing system, and then through the inner container to the beer, thereby reducing the shelf life.

Traditionally such an inner container is made from a metallised foil, because in general it has a very low oxygen permeability.

However, the thin metal layer of such foils can be easily damaged through movements, folds or creases, such that 'micro-cracks' occur and the oxygen permeability can suddenly quickly increase.

The purpose of the present invention is to provide a solution to at least one of the aforementioned and other disadvantages by providing a container for storing a liquid foodstuff and dispensing it under pressure in consumption portions via a closable dispensing channel leading from the container to the outside, whereby the container comprises a rigid outer container, a flexible inner container for the foodstuff, and at least one intermediate container surrounding the inner container, whereby an intermediate container on the one hand, and another intermediate container located within it or the inner container on the other hand, define a space and whereby the space is provided with a pressure medium and/or the container is equipped with a connection, which is connected to the space, for a pressure medium source.

The advantage of this is that a wide choice of materials and manufacturing methods for the outer container are available, because it is only used for the mechanical rigidity of the container, and not to keep the pressure medium inside, such that the outer container can be manufactured cheaply.

The two aforementioned functions of the container are hereby separated, en taken care of by different components: The outer container ensures mechanical resistance against the pressure which prevails internally in the container, and the intermediate container provides a diffusion barrier.

In a preferred embodiment the outer container has a mouth with a suitable connector in it or on it in which the dispensing channel is placed, whereby the connector is provided with an activatable valve for the controlled outflow of the foodstuff, and whereby the inner container is connected to the connector and in the empty state can be put in and taken out of the outer container through the mouth.

This makes it easy for a foodstuff supplier to fill the container by first placing an empty inner container in the outer container and putting the connector in place, and then filling the inner container with a foodstuff.

In a further preferred embodiment at least one intermediate container is also connected to the connector and in the empty state can be put in and taken out of the outer container through the mouth.

This has the advantage that an opening in the space between the inner and outer container, for example to let a pressure medium flow in, can be made very small so that only very limited amounts of air, which has the potential to degrade the foodstuff, can get into the container through this opening.

In a further preferred embodiment, the container is provided with a complementary connector to which the pressure medium source can be connected, whereby the combination of the connector and the complementary connector is provided with interconnecting cavities in order to form a channel to guide the pressure medium into the space.

This enables the complementary connector to be reused, while this is less desirable for the connector due to hygiene considerations when reused. Also, the working pressure of the entire container can be adjusted by only adapting the complementary connector.

In a further preferred embodiment the channel is equipped with a stop valve that closes off the channel when the activatable valve is not activated and opens the channel when the activatable valve is activated.

In this way the pressure medium is only let into the space when the valve is activated, thus when the container is used to dispense foodstuff. To this end, even if a loss of pressure medium from the space occurs to a limited extent, the loss of pressure medium is minimised and thus a long possible usage time with a small quantity of pressure medium is obtained, because only a small part of the pressure medium can be lost, i.e. as a maximum the quantity that is in the space.

In a further preferred embodiment the pressure medium source is a capsule with the pressure medium under pressure, whereby the pressure medium is a gas.

Preferably, in the complementary connector there is a piercing instrument, driven by a spring, activatable from outside the complementary connector, for a pierceable seal of the capsule, that can be put back in its starting position by the pressure of the gas escaping from the capsule after piercing the seal.

In this way the gas capsule can be permanently closed until the container is used for the first time, so that certainly no gas is lost.

As a result of the gas pressure pushing back the piercing instrument to its starting position, the reuse of the complementary connector is easier.

In a preferred embodiment, the inner container and/or at least one intermediate container has high resistance to the permeation of oxygen.

As a result the foodstuff is well protected from attack by oxygen.

A high resistance is hereby obtained through the nature of the materials from which the inner container and/or intermediate container are made and the thickness of them. On the other hand, the extent to which this resistance is preserved after deformation, for example by filling and/or partially emptying, is important.

Because the surface area/content ratio of the inner container can vary depending on the content of the container, and because different foodstuffs have different acceptable limits for oxygen, a general limit for the permeability of the inner container and/or intermediate container cannot be given.

However, this can be calculated by a person skilled in the art as being the value at which the limit for oxygen in the product due to the diffusion of oxygen is only exceeded after a set period, the desired storage period.

For non-secondary fermenting beer, such as lager, the limit is 3000 ppb, preferably 2000 ppb, and even more preferably 1000 ppb, for a desired storage period of 6 months, preferably 12-months, and even more preferably 24 months.

In a further preferred embodiment at least one intermediate container within which the space is located has a high resistance to the permeation of the pressure medium.

This enables the loss of pressure medium from the container to be limited, even with an outer container that is permeable to the pressure medium, or which is even not fully closed off.

Preferably the material of the inner container and/or at least one intermediate container contains a layer of polyvinyl alcohol.

Such a layer has good resistance to the permeation of oxygen, whereby the container keeps oxygen well away from the foodstuff, even without a metal layer.

In a further preferred embodiment, the outer container is at least partially or entirely made of polyethylene, polypropylene or polyethylene terephthalate. These are materials that are strong and cheap, and can easily be made into an outer container, and are thereby pre-eminently suitable for a container according to the invention.

In a further preferred embodiment, components of the connector that form a barrier between the atmosphere and foodstuff are at least partly made from a polymer that at least partly consists of a polyamide that contains meta xylyline units.

Such a polyamide is MXD-6 for example that is an aliphatic polyamide that is made according to the polycondensation of meta xylyline diamine with adipic acid.

If the components of the connector that form a barrier between the atmosphere and the foodstuff are made from this material, or a mixture of it with other polymers, the entire connector has a low permeability to oxygen, so that the foodstuff is completely surrounded by an oxygen barrier and a long shelf life is thus possible.

With the intention of better showing the characteristics of the invention, a preferred embodiment of a container according to the invention is described hereinafter by way of an example, without any limiting nature, with reference to the accompanying drawings, wherein.

Figure 1:
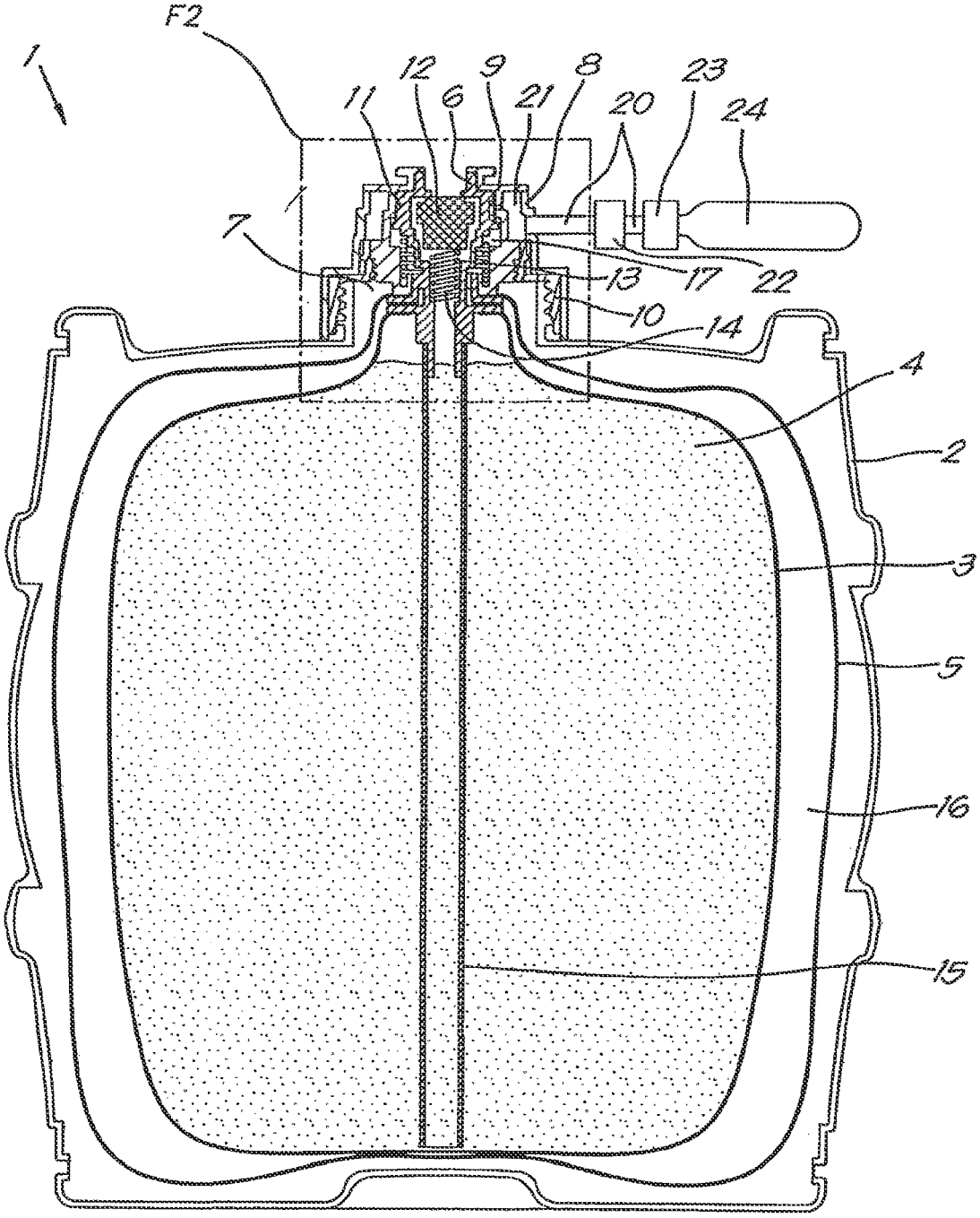
FIG. 1 shows a cross-section of a container according to the invention.

The keg 1 shown in FIG. 1 primarily consists of the following components: an outer container 2 that is mechanically strong; an inner container 3 that is filled with beer 4; an intermediate container 5 that is between the inner container 3 and outer container 2; a connector 6 to which the inner container 3 and intermediate container 5 are connected and which is mounted in a mouth 7 of the outer container 2, and a complementary connector 8 that is also mounted on the mouth 7.

In this example the outer container 2 is made of polyethylene because it is a cheap material that is easy to form, but it can also be made of other materials.

The inner container 3 and intermediate container 5 are made of a nine-layered nylon-based flexible foil, without metal layer, but with a polyvinyl alcohol (PVA) layer.

This foil has a permeability to $O_2$ and $CO_2$ of 0.27 $ml/m^2 \cdot day$, measured according to the ASTM D1434 standard.

The connector 6 contains a fixed part 9 that is screwed into the mouth 7 using an adapter 10.

The connector 6 also comprises a first closing part 11 and second closing part 12 that are both movable in the fixed part 9.

The first closing part 11 is pushed against the fixed part 9 by a compressed first spring 13, so that the fixed part 9 forms a stop for the first closing part 11.

The second closing part 12 is pushed by a compressed second spring 14 against the first closing part 11 so that the first closing part 11 forms a stop for the second closing part 12.

A riser pipe 15 is secured to the first closing part 11 that runs up to the bottom of the inner container 3.

The inner container 3 and intermediate container 5 are secured to the first closing part 11 in such a way that the space 16 between the inner container and intermediate container is in an open connection to the space 17 between the first closing part 11 and the fixed part 9.

In the first closing part 11 there is a first gas passage 18. There is a second gas passage 19 through the fixed part 9.

The complementary connector 8 is affixed around the mouth 7 and the connector 6, and comprises a gas channel 20, which at one end comes out into the space 21 between the connector 6 and the complementary connector 8, and at the other end is connected to a capsule 24 of pressurised $CO_2$ via an expander 22 forming part of the complementary connector 8 and coupling 23.

The space 21 between the connector 6 and the complementary connector 8 connects to the second gas passage 19.

In this example, the first connector 11 and the second connector 12 are made from MXD-6, a polyamide of meta xylylene diamine and adipic acid, and which thus contains meta xylylene units. As a result the first closing part 11 and the second closing part 12 form a good barrier to the permeation of oxygen.

Mixtures of this polyamide with other polymers present a similar effect.

The various components are provided with seals, not shown, so that they are connected together in a liquid-tight and gas-tight way.

The keg 1 is composed as follows:

A connector 6 with inner container 3 and intermediate container 6 connected to it are brought through the complementary connector 8. Then the riser pipe 15, the inner container 3 and the intermediate container 5 are brought through the mouth 7, fitted with an adapter 10, of the outer container 2 into the outer container 2, and the connector 6 is screwed onto the adapter 10, thereby clamping the complementary connector 8 between itself and the outer container 2.

Then the keg 1 is filled with beer 4 by connecting a filling installation to the connector 6 by means of a coupling that pushes the first closing part 11 and the second closing part 12 inwards, away from their respective stops, in the direction of the arrows P, and thereby opens a beer channel to the space inside the inner container 3. Beer 4 now flows through this beer channel from the filling installation into the inner container 3.

As soon as the inner container 3 is full the filling installation is disconnected from the keg 1. The first and second closing parts (11,12) pushed back against their stops by the first spring 13 and the second spring 14 form a stop valve that keeps the beer 4 in the keg 1.

The beer 4 in the keg 1 is now well protected against degradation by oxygen such that the keg 1 with beer 4 can be stored for many months, and even years, without a risk of degradation by oxygen.

The outer container 2 has a relatively high permeability to oxygen, but the intermediate container 5 and the inner container 3 do not, such that oxygen cannot get into the beer 4 through this route. At the same time oxygen cannot get into the beer 4 through the connector 6, because the components, i.e. the first connecting part 11 and the second connecting part 12, through which oxygen could get into the beer 4, are constructed from oxygen-tight material.

In order to be able to tap beer from the keg 1 a pressure medium first has to be provided in the space 16. This is done by screwing a $CO_2$ capsule 24 onto the coupling 23 whereby the coupling 23 is designed such that the $CO_2$ capsule 22 is opened when connected.

Figure 2:
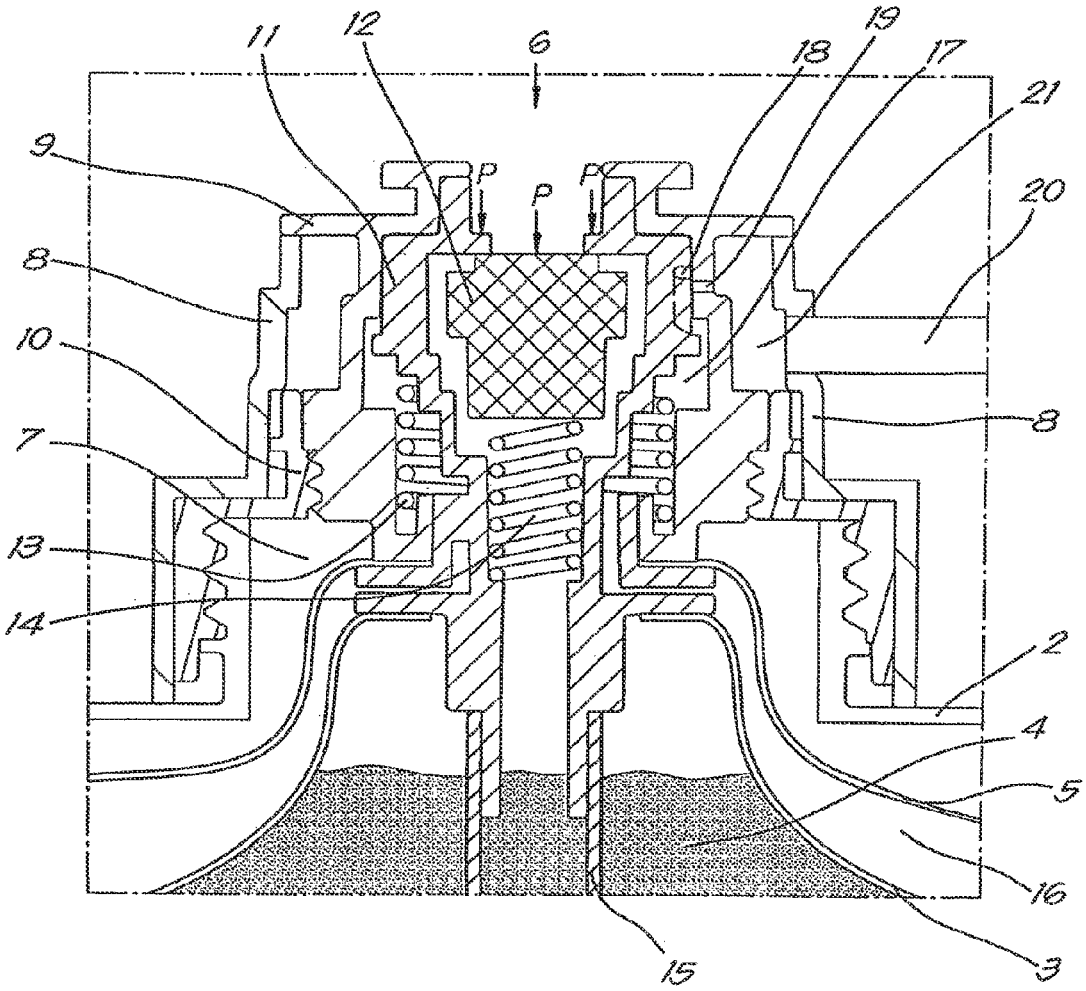
FIGS. 2 and 3 show the part indicated in FIG. 1 by F2 in more detail and on a larger scale, in two different usage states.
Figure 3:
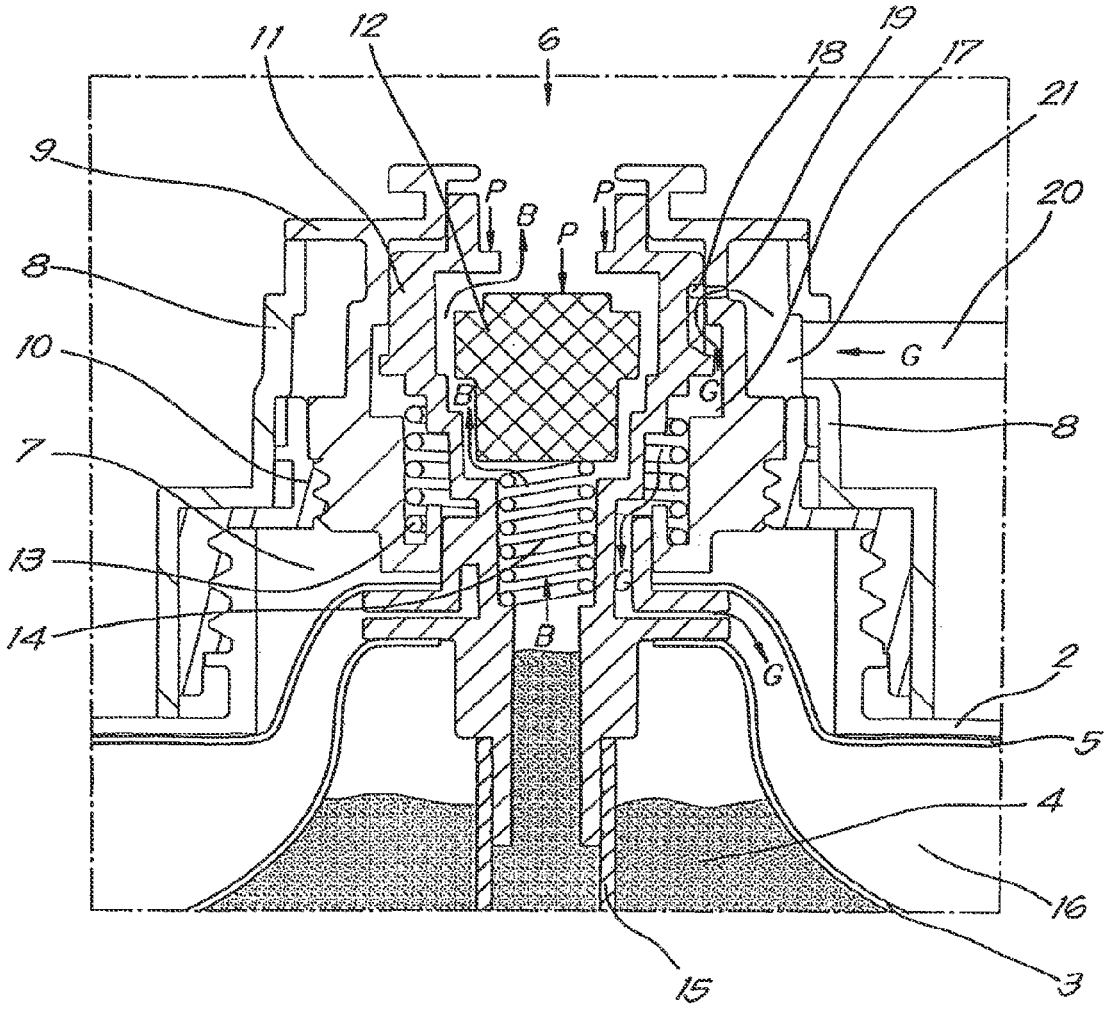

A tap also has to be provided with a mechanism that can press into the first closing part 11 and the second closing part 12 in the direction of the arrows P, as drawn in FIGS. 2 and 3, in other words that can activate the valve formed by the first closing part 11 and the second closing part 12.

As a result, the first gas passage 18 and the second gas passage 19 are connected together, and an open channel occurs, shown in FIG. 3 by the arrows G, between the $CO_2$ capsule 24 and the space 16 between the inner container 3 and the intermediate container 5, via the gas channel 20, the expander 22 that brings the pressure to a desired level, the space 21 between the connector 6 and the complementary connector 8, the second gas passage 19, the first gas passage 18 and the space 17 between the first closing part 11 and the fixed part 9.

$CO_2$ now flows out of the $CO_2$ capsule 24 into the space 16 between the inner container 3 and intermediate container 5. The intermediate container 5 is hereby pushed against the outer container 2, and pressure is exerted on the inner container 3.

By pressing in the first closing part 11 and the second closing part 12, a beer channel is also opened, indicated by the arrows B in FIG. 3, through which beer 4 can flow under the influence of the pressure exerted on the inner container 3 by the $CO_2$ to the outside via the riser pipe 15, and can be tapped via the tap in serving portions.

When the tap no longer activates the valve, thus no longer exerts the force P, the first closing part 11 and the second closing part 12 are pushed against their stops by the first spring 13 and the second spring 14, such that beer 4 can no longer flow.

The first closing part 11 and the fixed part 9 together form a stop valve for the channel between the $CO_2$ capsule 24 and the space 16, by the first gas passage 18 and the second gas passage 19 no longer being connected together.

The expander 22 prevents the pressure in the gas channel and 20 and thus in the space 16 from becoming too high.

Thanks to the good resistance of the intermediate container 5 to the permeation of $CO_2$, no $CO_2$ is lost, such that the pressure remains at the required level, even when a keg 1 is only partly tapped and is then not used for a long time, after which it is further tapped, without a $CO_2$ capsule 24 with an excess of $CO_2$ having to be provided for this purpose, or a new capsule having to be fitted.

Thanks to the good resistance of the inner container 3 to the permeation of $CO_2$, $CO_2$ diffusion into the beer 4, and thus the oversaturation of it, is prevented.

When the keg 1 is tapped empty, the outer container 1 and the complementary connector 8 can be used again, while for hygiene reasons it is better not to reuse the connector 6 with the inner container 3 and the intermediate container 5 fastened to it, although in theory this is not ruled out if they are well cleaned and disinfected.

Figure 4:
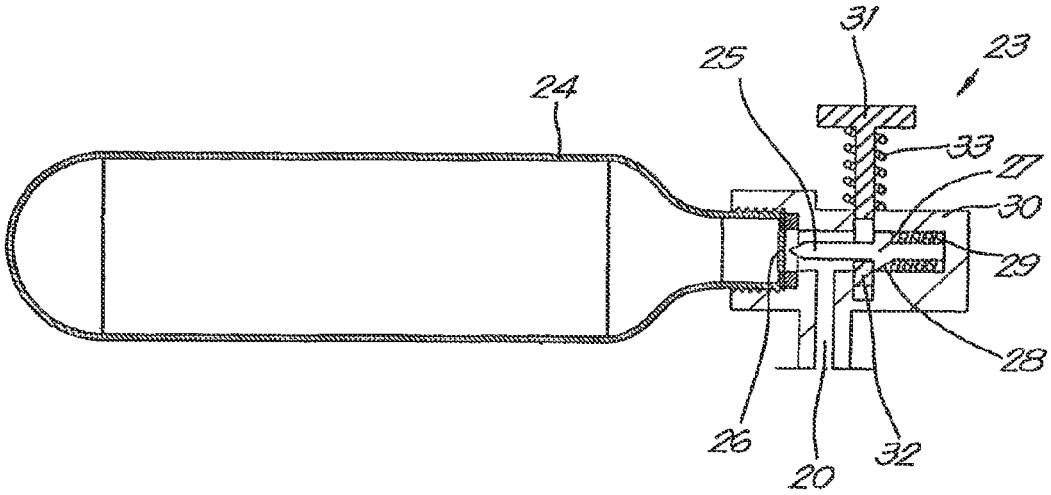
FIGS. 4 and 5 show a cross-section of a preferred embodiment of a component of a container according to the invention in two different usage states.
Figure 5:
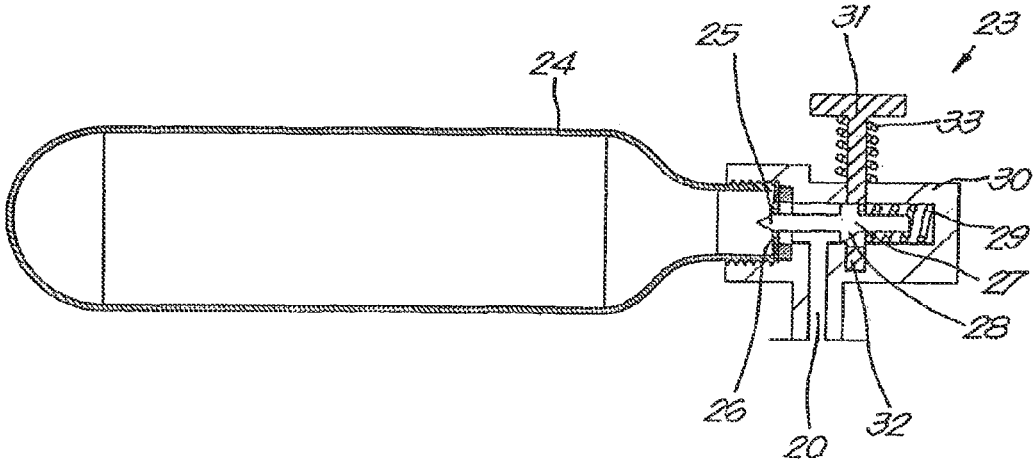

FIGS. 4 and 5 show a cross-section of a specific embodiment of the coupling 23 with a $CO_2$ capsule 24.

This coupling 23 comprises a piercing instrument in the form of a pin 25 in order to make a hole in a seal 26 of the capsule 24 and thereby activate the capsule.

The pin 25 is mounted on a body 27 with a catch 28. There is a piercing spring 29 between the housing 30 of the coupling 23 and the body 27. The coupling 23 further comprises a pushbutton 31 with a stop part 32 connected to it, fitted with a return spring 33.

The operation of this coupling 23 is as follows.

First the coupling 23 is placed in the starting position. To this end the body 27 is pushed into the housing 30, such that the piercing spring 31 is compressed until the catch 28 comes behind the stop part 32. The stop part 32 now forms a stop for the catch 28 that is pushed against it by the piercing spring 29.

Then a $CO_2$ capsule 24, that is closed by a pierceable seal 26, is fastened to the coupling 23. This situation is shown in FIG. 4.

If the pushbutton 31 is now pressed in, simultaneously compressing the return spring 33, the catch 28 is released from behind the stop part 32, such that the body 27 is pushed forcefully in the direction of the $CO_2$ capsule 24 by the piercing spring 29, and the pin 25 pierces the seal 26 such that $CO_2$ can flow out of the capsule 24.

The button 31 is positioned such that it can be pressed in from the outside of the keg (1).

This situation shown in FIG. 5.

The $CO_2$ now released exerts a pressure, and thus a force, on the body 27. The piercing spring 31 is calculated such that the force exerted by it is less than the force exerted by the $CO_2$ pressure, such that the body is pushed back to its starting position. The pushbutton 31 is also pushed back by the return spring 23, such that the catch 28 again comes behind the stop part 32.

The coupling 23 is now ready to activate a subsequent capsule 24 without any difficulty.

A coupling operating in this way, and an activation mechanism for a piercing instrument as integrated in it, are not only useful in combination with a container according to the invention, but also for other applications.

In the above example the keg 1 is intended for beer 4. However, a container according to the invention can also be used for many other liquid foodstuffs. The specific embodiment of the container, and the way of introducing the pressure medium into the space between the inner container and intermediate container, can differ from that which is described in the specific example.

In the embodiment described above both the intermediate container and the inner container are fastened to the connector. This is not necessary for the good operation of the container.

In the embodiment described above, both the intermediate container and the inner container have good resistance to the permeation of $CO_2$ and oxygen. This concerns a preferred embodiment in various respects:

In order to achieve the advantage of the invention, the separation of the gas retention function and the mechanical strength of the outer container compared to the known containers, a particular resistance to the permeation of these gases is not necessary.

In order to obtain the advantage of good protection of the foodstuff against degradation by oxygen, a good resistance to the permeation of oxygen is only necessary for at least one of the inner container and intermediate container.

In order to obtain the advantage of good retention of $CO_2$, and thereby a long operating duration with a small $CO_2$ capsule, a good resistance to the permeation of $CO_2$ is only necessary for the intermediate container.

The present invention is by no means limited to the embodiment described as an example and shown in the drawings, but a container according to the invention can be realised in all kinds of variants, without departing from the scope of the invention.

The invention claimed is:

1. A container (1) for storing a liquid foodstuff (4) and dispensing it under pressure in consumption portions via a closable dispensing channel leading from the container to the outside, comprising:

a rigid outer container (2), a flexible inner container (3) for the foodstuff (4), and an intermediate container (5) surrounding the inner container (3), whereby a space (16) is defined between the intermediate container and the inner container, whereby the space (16) is configured to be provided with a pressure medium, wherein the outer container (2) has a mouth (7) with a connector (6) fitting in it in which the dispensing channel is provided, whereby the connector (6) is provided with an activatable valve for the controlled outflow of the foodstuff (4), and whereby the inner container (3) is connected to the connector (6) and in an empty state can be put in and taken out of the outer container (2) through the mouth (7), wherein the container (1) is provided with a complementary connector (8) to which the pressure medium source (24) can be connected, whereby the combination of the connector (6) and the complementary connector (8) is provided with interconnecting cavities to form a channel in order to guide the pressure medium to the space (16), wherein the pressure medium source is a capsule (24) of the pressure medium under pressure, whereby the pressure medium is a gas, and wherein a piercing instrument (25) for a pierceable seal (26) of the capsule (24), driven by a spring (29), activatable from outside the complementary connector (8), is provided in the complementary connector (8), and can be brought back to the starting position by the pressure of the gas escaping from the capsule (24) after piercing the seal (26).

2. A container (1) according to claim 1, wherein the container (1) is for beer (4).

3. A container (1) according to claim 1, wherein the intermediate container (5) is flexible.

4. A container (1) according to claim 1, wherein the intermediate container (5) is connected to the connector (6) and in an empty state can be put in and taken out of the outer container (2) through the mouth (7).

5. A container (1) according to claim 1, wherein the channel is provided with a stop valve that closes the channel when the activatable valve is not activated and opens the channel when the activatable valve is activated.

6. A container (1) according to claim 1, wherein there is only one intermediate container (5).

7. A container according to claim 3, wherein the inner container (3) and the intermediate container (5) has a high resistance to the permeation of oxygen.

8. A container (1) according to claim 1, wherein the intermediate container (5) within which the space (16) lies has a high resistance to the permeation of the pressure medium.

9. A container (1) according to claim 1, wherein the material of the inner container (3) and the intermediate container (5) includes a polyvinyl alcohol layer.

10. A container (1) according to claim 1, wherein the outer container (2) is at least partly made from polyethylene terephthalate.

11. A container (1) according to claim 1, wherein components of the connector (6) that form a barrier between the atmosphere and the foodstuff (4) are at least partly made from a polymer that at least partly consists of polyamide that contains meta-xylylene units.

12. A container (1) according to claim 1, wherein the outer container (2) is at least partly made from polyethylene or polypropylene.

13. A container (1) according to claim 9, wherein the container (1) contains beer (4).

14. A container (1) according to claim 12, wherein the container (1) contains beer (4).

15. A container (1) according to claim 3, wherein the intermediate container (5) is flexible.

16. A container (1) according to claim 1, where there are a plurality of intermediate containers (5) and the space (6) is defined therebetween.

* * * * *